US008915269B2

(12) United States Patent
Krulitsch et al.

(10) Patent No.: US 8,915,269 B2
(45) Date of Patent: Dec. 23, 2014

(54) METHOD AND FILLING SYSTEM FOR FILLING CONTAINERS WITH A FILLING MATERIAL COMPOSED OF AT LEAST TWO COMPONENTS IN A VOLUME-AND/OR AMOUNT-CONTROLLED MANNER

(75) Inventors: Dieter-Rudolf Krulitsch, Bad Kreuznach (DE); Jonathan Lorenz, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 13/513,882

(22) PCT Filed: Dec. 7, 2010

(86) PCT No.: PCT/EP2010/007409

§ 371 (c)(1),
(2), (4) Date: Jun. 5, 2012

(87) PCT Pub. No.: WO2011/101012

PCT Pub. Date: Aug. 25, 2011

(65) Prior Publication Data

US 2012/0241044 A1 Sep. 27, 2012

(30) Foreign Application Priority Data

Feb. 16, 2010 (DE) ..... 10 2010 008 166

(51) Int. Cl.
*B67C 3/02* (2006.01)
*B67C 3/20* (2006.01)

(52) U.S. Cl.
CPC . *B67C 3/20* (2013.01); *B67C 3/023* (2013.01); *B67C 3/206* (2013.01)
USPC ..... 141/105; 141/9; 141/103; 222/71

(58) Field of Classification Search
USPC ..... 141/9, 100, 103, 105, 248; 222/71
See application file for complete search history.

(56) References Cited

U.S. PATENT DOCUMENTS

| | | | | |
|---|---|---|---|---|
| 2002/0074348 | A1 | 6/2002 | Heyes | |
| 2009/0236007 | A1 | 9/2009 | Clusserath et al. | |
| 2010/0300580 | A1 * | 12/2010 | Macquet et al. | 141/83 |
| 2011/0023994 | A1 * | 2/2011 | Meinzinger | 141/1 |
| 2011/0039044 | A1 * | 2/2011 | Clusserath | 428/34.1 |
| 2012/0180902 | A1 * | 7/2012 | Neuhauser et al. | 141/9 |

FOREIGN PATENT DOCUMENTS

| | | |
|---|---|---|
| DE | 8805380 | 6/1988 |
| DE | 102006045987 | 4/2008 |
| DE | 102009049583 | 5/2011 |
| EP | 2272790 | 1/2011 |
| FR | 2925022 | 6/2009 |
| WO | 2009/129937 | 10/2009 |
| WO | 2011/044972 | 4/2011 |

* cited by examiner

*Primary Examiner* — Timothy L Maust
(74) *Attorney, Agent, or Firm* — Occhiuti & Rohlicek LLP

(57) ABSTRACT

An apparatus for filling a container with a two-component filling material includes separate liquid channels for the two components. Each channel has a controllable valve. A flow meter is configured for directly measuring an amount of the first component fed to the container and indirectly measuring an amount of the second component fed to said container. It does the indirect measurement by measuring a flow rate of the first component resulting from a flow rate of the second component. Each component has an associated variable-volume chamber configured so that a volume change in one leads to an inverse volume change in the other. This affects flow rate of the first component.

16 Claims, 2 Drawing Sheets

METHOD AND FILLING SYSTEM FOR FILLING CONTAINERS WITH A FILLING MATERIAL COMPOSED OF AT LEAST TWO COMPONENTS IN A VOLUME-AND/OR AMOUNT-CONTROLLED MANNER

CROSS REFERENCE TO RELATED APPLICATIONS

This application is the national stage entry under 35 USC 371 of international application no. PCT/EP2010/007409, filed Dec. 7, 2010, which claims the benefit of the Feb. 16, 2010 priority date of German application no. 10 2010 008 166.3. The contents of the aforementioned applications are incorporated herein in their entirety.

FIELD OF DISCLOSURE

This disclosure relates to filling containers with a filling material.

BACKGROUND

Methods and filling systems are known for filling containers with a liquid filling material composed of at least two components that are introduced separately into the respective container in a volume-controlled and/or amount-controlled manner, in particular also for the bottling of fruit juices in which case one component is a homogenous liquid and a further component exhibits, for example, a high proportion of solids, e.g. fruit pulp and/or fruit fiber.

Volume-measuring or amount-measuring devices or flowmeters, in particular contactlessly operating electronic flowmeters, for example magnetically inductive flowmeters, which may be very suitable for electrically conductive liquid and homogenous components and provide exact measurement signals depending on the particular volumetric flow rate but which are not or only partly suitable for non-homogenous components and in particular components containing a high concentration of solids, are often used for volume-controlled or amount-controlled filling.

For the volume-controlled or amount-controlled filling of a filling material composed of two components, it has already been proposed in our own but not yet published patent application DE 10 2009 049 583.5 that each of the components that are to be sequentially introduced into the respective container be provided with its own liquid path connected to a storage tank for the component concerned, and that a flowmeter be disposed in only one of the liquid paths, namely in the liquid path for a first liquid and homogenous component, said flowmeter directly measuring the amount of that component introduced into the respective container during filling and indirectly measuring the amount of a second component introduced into the respective container. This latter is achieved in that, before it is introduced into the container, the second component is passed into a part-length of the liquid channel of the first component and in the process the first component is displaced on this part-length and returns through the flowmeter into a tank holding the first component. This returning amount of the first component is measured with the flowmeter. The introduction of the second component into the tank does not take place directly while measuring, but in a further process step after measuring. There is a certain disadvantage in the fact that the components can mix together in the first liquid channel or in the part-length of said channel, and that, when being measured, the amounts of the first and second component flow through the flowmeter in opposite directions which can lead to measurement errors and/or necessitate a complex calibration of the flowmeter concerned.

The object of the invention is to provide a method and apparatus that avoids the foregoing disadvantages. Suitable methods and apparatuses are recited in the attached claims.

In the case of the invention, the amount or volume of the at least one second component is also measured indirectly by measuring or capturing the first component's volumetric flow rate which results from the volumetric flow rate of the at least one second component, the volumetric flow rate of the least one second component being the volumetric flow rate of this component directly flowing to the respective container. During direct and indirect measuring of the amount or volume of all components, the flow through the flowmeter used for the measurement is in one and the same direction, this also being the direction of flow in which the first component flows through the first liquid channel when introduced into the respective container. This is made possible by the fact that at least one first chamber is associated with the first liquid channel for the first component and at least one second chamber with variable volume is associated with the second liquid channel for the second component, and that when the second component is introduced into the respective container, the volume of the at least one second chamber associated with the second component is reduced, starting from an initial volume and accompanied by an increase in the volume of the at least one first chamber associated with the first component. As a result of this the first component flows through the flowmeter and on into the at least one first chamber. The amount (volume) of the first component measured by the flowmeter is equal to the amount (volume) of the second component introduced into the container. If the volume-controlled or amount-controlled introduction of several "second" components into each container is necessary, then the above described indirect measurement of the amounts (volumes) of the "second" components is carried out with a time delay.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

The invention is described below in greater detail by reference to FIGS. 1 and 2 which each schematically show a filling position of a filling systems for filling containers with two components K1 and K2 of a filling material.

DETAILED DESCRIPTION

Figure 1:
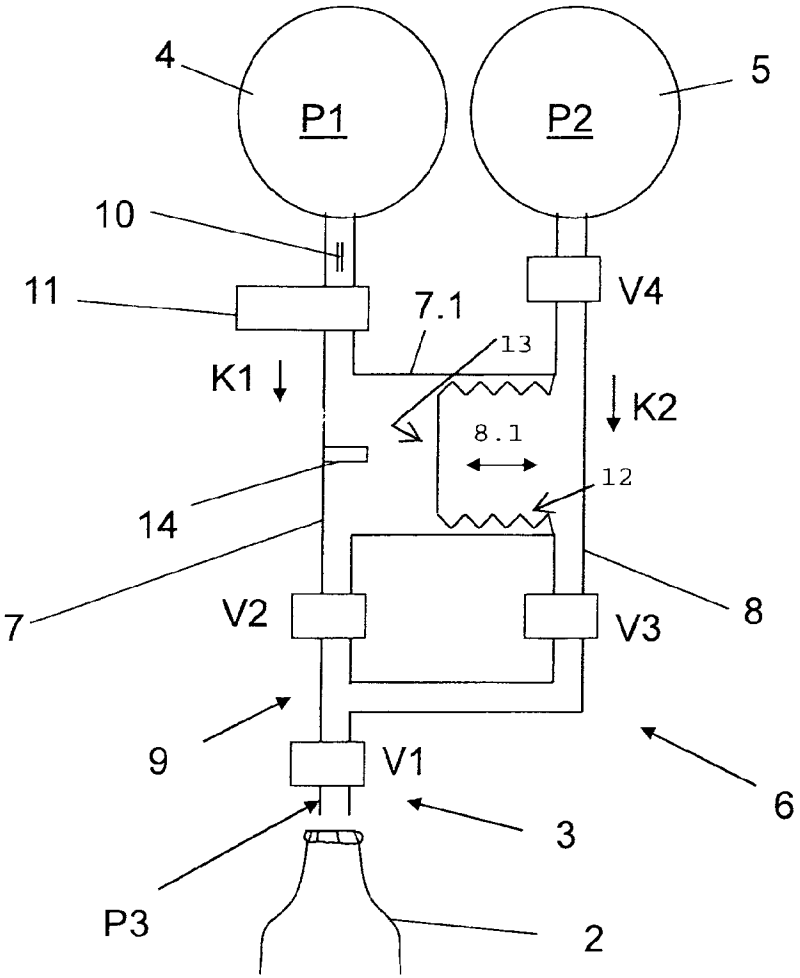

FIG. 1 shows a schematic function representation of part of a filling system 1, for example of a rotary filling machine for filling containers 2 with the different components K1 and K2. During a filling process these components are introduced into the respective container 2 in an amount-controlled and/or volume-controlled manner in a given mix ratio or each with a given nominal volume, and also in such a way that each container 2 contains a given total amount of the mixed product, for example of a drink or fruit juice.

Component K1 is for example a liquid homogenous or essentially homogenous component, for example fruit juice. Component K2 is for example a non-homogenous component which with a reduced proportion of liquid contains a high proportion of solids, e.g. in the fruit pulp and/or fruit fibres etc.

Filling system 1 comprises a plurality of filling positions, each with a filling element 3, which in the case of rotary filling machines is provided together with further filling elements on the periphery of a rotor driven to rotate about a vertical machine axis in the manner known to the person skilled in the art. Filling element 3 is configured with a valve V1 (liquid valve) for the controlled starting and stopping of the filling process. During the filling process, the respective container 2 is disposed under filling element 3 or under a delivery opening there located, and in the depiction of FIG. 1 is at a distance away from filling element 3 for open jet filling. There are provided jointly for all filling elements 3 of the filling system two tanks 4 and 5, of which, during the filling operation tank 4 contains component K1 with a pressure P1 and tank 5 contains component K2 with a pressure P2. At the delivery opening of filling element 3, components K1 and K2 flowing to container 2 exhibit the filling pressure P3, which in the case of open jet filling is equal to the ambient pressure. The pressure in tanks 4 and 5 is set so that pressure P1 is less than pressure P2 but greater than pressure P3, hence P3<P1<P2.

Filling element 3 is connected to both tanks 4 and 5 by a liquid connecting and proportioning structure which is generally indicated by 6 in FIG. 1. Within filling system 1 there is provided for each filling element 3 or for each filling position a separate liquid connecting and proportioning structure 6 each of which consists essentially of two liquid paths or liquid channels 7 and 8, of which liquid channel 7 is connected to tank 4 for component K1 and liquid channel 8 to tank 5 for component K2, and which in the direction of flow of components K1 and K2 flow at a mouth 9 into a common liquid channel of filling element 3, said channel being the continuation of liquid channel 7 in FIG. 1.

In liquid channel 7 there are provided sequentially in the direction of flow from tank 4 to liquid valve 3, a restrictor 10 for reducing the volumetric flow rate of component K1 when valves V1 and V2 are open, a flowmeter 11, for example in the form of a magnetically inductive flowmeter, and a valve V2. Liquid channel 7 is configured with an extension or first chamber 7.1 in the region between flowmeter 11 and valve V2.

A control valve V4 and a control valve V3 are provided sequentially in liquid channel 8 in the direction of flow from tank 5 to filling element 3 and/or to mouth 9. Between the two valves V4 and V3, liquid channel 8 is configured with an extension or second chamber 8.1 which in the depicted embodiment is formed by the interior space of a bellows 12 protruding into chamber 7.1. Bellows 12 or its movable and/or deformable walls separate the two chambers 7.1 and 8.1 in a fluid-tight or liquid-tight manner. Consequently chamber 8.1 possesses a variable volume to the extent that the volume of chamber 7.1 changes in inverse proportion to the volume of chamber 8.1.

It is self-evident that other embodiments of chambers whose volumes are inter-dependent in inverse proportion can also be used instead of bellows 12.

It is alternatively possible for example to provide a piston/cylinder arrangement which provides this function. For this, a cylinder with a preferentially overhung-mounted piston would have to be provided, with the piston being pressurised with the one component on the one side and with the other component on the other side. As a result of this arrangement the piston constitutes the separation or plane of separation between the two components, with the volumes of the two chambers 7.1 and 8.1 also being inter-dependent in inverse proportion. Because the piston is also easily displaceable through pressure differences between the two components, the chamber volumes can be easily adapted or altered in the desired manner.

Filling system 1 offers the advantage that with the aid of the only flowmeter 11, an amount-based and/or volume-based proportioning or introducing of components K1 and K2 into respective container 2 is possible, whereby during the measurement component K1 flows through flowmeter 11 in one direction of flow only, namely in the direction of flow from tank 4 to filling element 3. With the aid of flowmeter 11, the amount (volume) of component K1 fed to respective container 2 is measured directly and the amount (volume) of component K2 fed to respective container 2 is measured indirectly. The modus operandi of filling system 1 can be described as follows:

1.1. Initial State of Filling System 1

The valves in this phase of the filling process exhibit the following status:

V1: Closed
V2: Closed
V3: Closed
V4: Open

The two tanks 4 and 5 are filled with components K1 and K2 and pressurised pressurized with pressure P1 and P2. Bellows 12 lies with a base section 13 against a region of chamber 7.1 formed as a stop 14 that defines the greatest volume (initial volume) of chamber 8.1. Liquid channels 7 and 8 and their chambers 7.1 and 8.1 are completely filled with components K1 and K2 respectively.

1.2. Filling of Component K2 in Filling System 1

The valves in this phase of the filling process exhibit the following status:

V1: Open
V2: Closed
V3: Open
V4: Closed

Pressure P1 of component K1 in liquid channel 7 and in chamber 7.1 causes a compression of bellows 12 and hence an increasing reduction of the volume of chamber 8.1 as well as an introduction of component K2 via open valves V3 and V1 into container 2 standing ready under filling element 3. At the same time the volume in chamber 7.1 increases with the consequence of a volumetric flow rate of component K1 from tank 4 into chamber 7.1, with the amount (volume) measured by flowmeter 11 being equal to the amount of component K2 introduced from chamber 8.1 into container 2. Flowmeter 11 therefore supplies a measurement signal which corresponds to the amount (volume) of component K2 introduced into container 2 in this phase of the filling process.

The signal from flowmeter 11 stops this phase of the filling process in a controlled manner as soon as the required nominal volume of component K2 is introduced into container 2.

1.3. Filling of Component K1 in Filling System 1

The valves in this phase of the filling process exhibit the following status:

V1: Open
V2: Open
V3: Closed
V4: Open

Component K1 flows through open valves V1 and V2 into container 2 until the nominal volume for component K1 is reached. Monitoring is again effected by flowmeter 11. The measurement signal from flowmeter 11 closes valves V1 and V2 in a controlled manner when the nominal volume for component K1 is reached. The filling process is now complete. The filled container 2 can then removed from filling element 3 or from the filling position which exhibits this filling element.

1.4. Refilling Chamber 8.1 in Filling System 1

On completion of the filling process the liquid connection and proportioning section 6 is prepared for the filling of a further container 2. The status of the valves in this preparation phase is:

V1: Closed
V2: Closed
V3: Closed
V4: Open

The fact that pressure P2 is greater than pressure P1 causes component K2 to flow from tank 5 into chamber 8.1/bellows 12, so that eventually chamber 8.1 exhibits its maximum initial volume again and base section 13 lies against stop 14. The amount (volume) of component K1 which is displaced from chamber 7.1 flows through liquid channel 7 back to tank 4 without this amount (volume) being measured by flowmeter 11. The initial status is restored when the maximum initial volume of chamber 8.1 is reached, and the filling of the next container 2 can commence.

Figure 2:
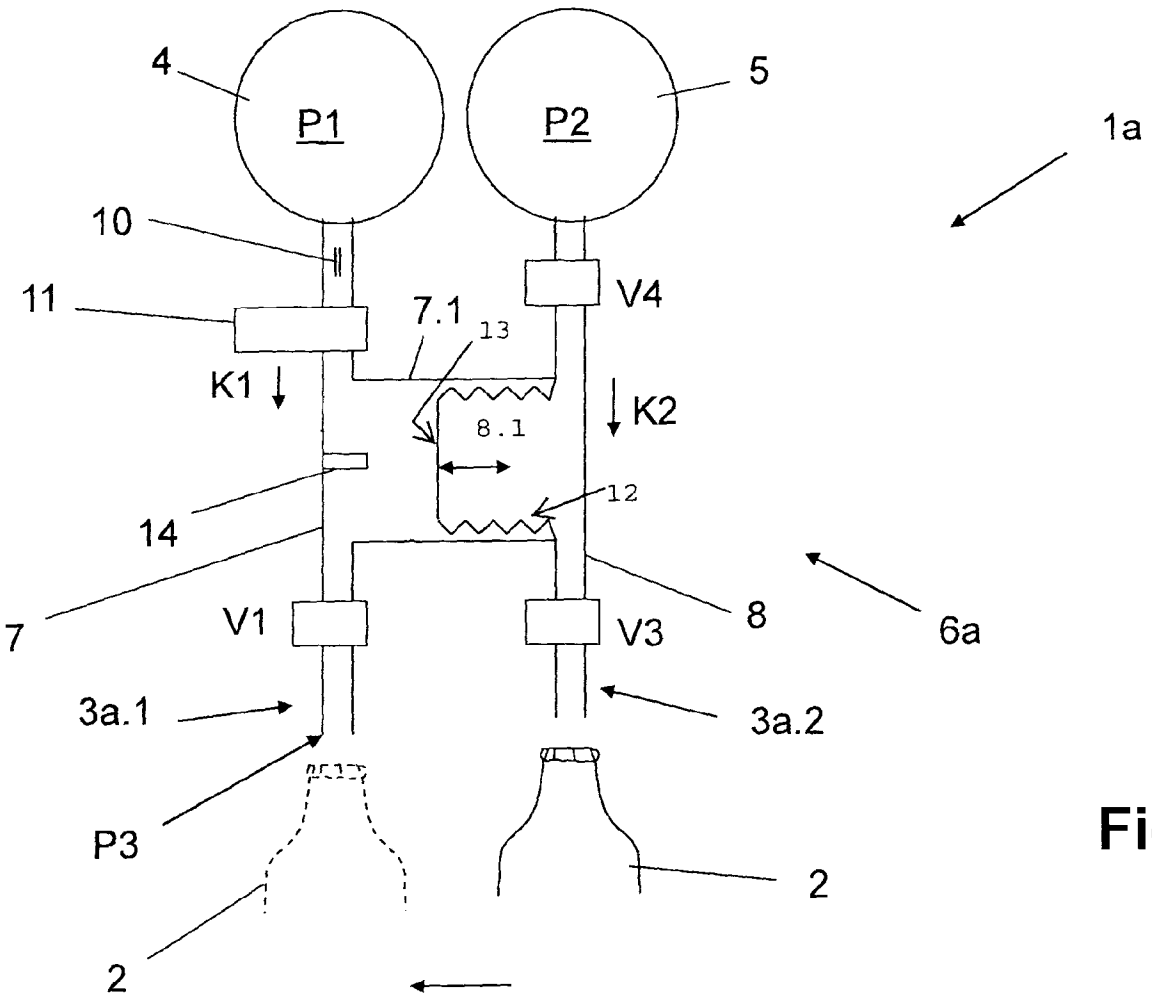

FIG. 2 shows as a further embodiment a filling system 1*a* which in essence only differs from filling system 1 in that the respective filling position exhibits two separate outlets or delivery openings for components K1 and K2, and wherein these outlets are formed either, as indicated in FIG. 2, by two independent filling elements 3*a*.1 and 3*a*.2 or by at least two separate delivery openings of one and the same filling element.

Accordingly liquid connecting and proportioning structure 6*a* which is again provided separately for each filling position of filling systems 1*a* differs from liquid connecting and proportioning structure 6 in that the two liquid channels 7 and 8 are not connected to one another but that instead liquid channel 7 is connected via valve V1 to the delivery opening of filling element 3*a*.1 and liquid channel 8 is connected via valve V3 to the delivery opening of filling element 3*a*.2. Valve V2 is not required.

The modus operandi of filling system 1*a* corresponds very broadly to that of filling system 1 and can be described as follows:

2.1. Initial State of Filling System 1*a*

The valves in this phase of the filling process exhibit the following status:

V1: Closed
V3: Closed
V4: Open

The two tanks 4 and 5 are filled with components K1 and K2 and pressurized with pressure P1 and P2. Bellows 12 lie with a base section 13 against a region of chamber 7.1 formed into a stop 14 that defines a greatest volume (initial volume) of chamber 8.1. Liquid channels 7 and 8 and their chambers 7.1 and 8.1 are completely filled with components K1 and K2 respectively.

2.2. Filling of Component K2 in Filling System 1*a*

The valves in this phase of the filling process exhibit the following status:

V1: Closed
V3: Open
V4: Closed

Here the respective container 2 is initially disposed beneath the delivery opening of filling element 3*a*.2.

Pressure P1 of component K1 in liquid channel 7 and in chamber 7.1 causes a compression of bellows 12 and hence an increasing reduction of the volume of chamber 8.1 as well as an introduction of component K2 via open valve V3 into container 2 standing ready under filling element 3*a*.2. At the same time the volume in chamber 7.1 increases with the consequence of a volumetric flow rate of component K1 from tank 4 into this chamber, with the amount (volume) measured by flowmeter 11 being equal to the amount of component K2 introduced from chamber 8.1 into container 2. Flowmeter 11 therefore supplies a measurement signal which corresponds to the amount (volume) of component K2 introduced into container 2 in this phase of the filling process.

The signal from flowmeter 11 stops this phase of the filling process in a controlled manner as soon as the required nominal volume of component K2 is introduced into container 2.

2.3. Filling of Component K1 in Filling System 1*a*

The valves in this phase of the filling process exhibit the following status:

V1: Open
V3: Closed
V4: Open

To introduce component K1 into container 2, the latter is disposed beneath filling element 3*a*.1; this can be effected by appropriate movement of the respective container 2 and/or filling elements 3*a*.1 and 3*a*.2 of the filling position concerned.

Component K1 flows through open valve V1 into container 2 until the nominal volume for component K1 is reached. Monitoring is again effected by flowmeter 11. The measurement signal from flowmeter 11 closes valve V1 in a controlled manner when the nominal volume for component K1 is reached. The filling process is now complete. The filled container 2 can then be removed from filling element 3*a*.1 or from the filling position which exhibits this filling element.

2.4. Refilling Chamber 8.1 in Filling System 1*a*

On completion of the filling process the liquid connection and proportioning section 6*a* is prepared for the filling of a further container 2. The status of the valves in this preparation phase is:

V1: Closed
V3: Closed
V4: Open

The fact that pressure P2 is greater than pressure P1 causes component K2 to flow from tank 5 into chamber 8.1/bellows 12, so that eventually chamber 8.1 exhibits its maximum initial volume again and base section 13 lies against stop 14. The amount (volume) of component K1 which is displaced from chamber 7.1 flows through liquid channel 7 back to tank 4 without this amount (volume) being measured by flowmeter 11. The initial status is restored when the maximum initial volume of chamber 8.1 is reached, and the filling of the next container 2 can commence.

The invention has been described hereinbefore by reference to embodiments. It goes without saying that variations as well as modifications are possible without departing from the inventive concept underlying the invention.

It is for example in particular possible to also realise chambers 7.1 and 8.1 with the variable volume by other means, for example generally by way of an enclosed space which is subdivided into chambers 7.1 and 8.1 by a movable wall or by at least one piston/cylinder arrangement having at least one piston axially displaceable in a cylinder and having two cylinder spaces which are separated from one another by, for example, this piston and of which one then forms chamber 7.1 and the other chamber 8.1.

It is also basically possible for liquid channel 8 with chamber 8.1, whose change of volume produces a corresponding volumetric flow rate in liquid channel 7 incorporating flowmeter 11, to be provided more than once so as to fill more than two components of a mixed product, for example of a mixed drink, into container 2 in an amount-controlled and/or volume-controlled manner while using a single flowmeter.

LIST OF REFERENCE SIGNS

1, 1*a* Filling system
2 Container
3, 3*a*.1, 3*a*.2 Filling element
4,5 Tank
6, 6*a* Liquid connecting and proportioning structure
7,8 Liquid channel
7.1,8.1 Chamber
9 Mouth opening of liquid channel 8 into liquid channel 7
10 Restrictor
11 Flowmeter
12 Bellows
13 Base section
14 Stop
K1, K2 Component
P1, P2, P3 Pressure
V1-V4 Valve

The invention claimed is:

1. A method comprising using a filling system for controlled filling of a container with a filling material comprising a first component and a second component, said filling system comprising a first liquid channel for said first component and a separate second liquid channel for said second component, said first liquid channel having a first variable-volume chamber, and said second liquid channel having a second variable-volume chamber, wherein using said filling system comprises feeding said first component into said container, directly measuring an amount of said first component, generating a flow rate of the first component that results from the flow rate of said second component by introducing said second component from said second chamber into the container, thereby reducing the volume of said second chamber, and carrying out a controlled introduction of said second component, wherein carrying out said controlled introduction comprises using a flow meter to indirectly measure said flow rate of said first component that results from a flow rate of said second component, wherein the reduction of the volume of the second chamber brings about an increase in the volume of the first chamber and hence a flow rate of the first component into the first chamber and through the flow meter, wherein controlled filling consists of one of amount-controlled filling and volume-controlled filling, wherein controlled introduction consists of one of amount-controlled introduction and volume-controlled introduction, and wherein flow rate consists of one of amount flow rate and volumetric flow rate.

2. The method of claim 1, wherein said first chamber is associated with said second chamber, and wherein the change of volume of the second chamber brings about an inverse change of volume of the first chamber.

3. The method of claim 1, further comprising providing a structure selected from the group consisting of a bellows, a bellows-like element, and a cylinder space of a piston/cylinder arrangement to form an interior space that defines at least one of said first chamber and said second chamber.

4. The method of claim 1, further comprising introducing said first component and said second component into the container through one of a common filling element, separate filling elements, and separate delivery openings.

5. The method of claim 1, further comprising pressurizing said first component by a first pressure, and effecting a change in volume of the second component upon introduction thereof into said container with support of at least said first pressure exerted upon said first component.

6. The method of claim 1, said method further comprising, upon completion of said filling process, and in preparation for a subsequent filling process, feeding said second component under pressure to said second chamber as a volume of said second chamber increases to an initial volume thereof through displacement of said first component out of said first chamber.

7. The method of claim 1, further comprising, before beginning a filling process, completely filling said second chamber and said second liquid channel with said second component, said second component being pressurized with a second pressure for filling said container, opening said second liquid channel for introducing said second component into said container at a third filling pressure that is lower than the second pressure, using said flow meter, measuring a flow rate of said first component that results from a flow rate of said second component, upon reaching a nominal volume of said second component introduced into said container, closing said second liquid channel, opening said first liquid channel, and using said flow meter, introducing said first component into said container with the required nominal volume in a controlled manner.

8. The method of claim 7, wherein said first pressure is greater than said third pressure, and wherein said first pressure is less than said second pressure.

9. An apparatus for filling a container with a filling material comprising a first component and a second component, said apparatus comprising a first liquid channel through which said first component is fed to said container, an amount of said first component being measured directly, a separate second liquid channel through which said second component is introduced into said container, a flow meter configured for directly measuring an amount of said first component fed to said container and configured for indirectly measuring an amount of said second component fed to said container by measuring a flow rate of said first component that results from a flow rate of said second component, a first variable-volume chamber provided in said first liquid channel for said first component, a second variable-volume chamber for said second component, said first chamber being assigned to said second chamber, and said first and second chambers being configured such that a volume change in said second chamber causes an inverse volume change in said first chamber that affects a flow rate of said first component into said first chamber and through said flow meter, a filling structure, a first controllable valve provided in said first liquid channel, and a second controllable valve provided in said second liquid channel, wherein said filling structure is selected from the group consisting of a common filling element, separate filling elements, and separate delivery openings for said components at each filling position, wherein filling comprises one of volume-controlled filling and amount-controlled filling, wherein said flow meter is one of an amount-measuring device and a volume-measuring device, wherein introduction comprises one of volume-controlled introduction and amount-controlled introduction, and wherein flow rate comprises one of volumetric flow rate and amount flow rate.

10. The apparatus of claim 9, wherein said flow meter is provided in said first liquid channel before said first chamber in a direction of flow of said first component.

11. The apparatus of claim 9, wherein a chamber selected from the group consisting of said first chamber and said second chamber is formed by one of a section of said first liquid channel, a section of said second liquid channel, an extension of said first liquid channel, and an extension of said second liquid channel.

12. The apparatus of claim 9, further comprising a separate controllable third valve in the second liquid channel disposed before said second chamber in a direction of flow of the second component.

13. The apparatus of claim 9, further comprising a source carrying said first component under a first pressure and said second component under a second pressure, wherein said first pressure is greater than a filling pressure, and wherein said first pressure is less than said second pressure, said source being connected to said first liquid channel and to said second liquid channel.

14. The apparatus of claim 13, wherein said source comprises a tank.

15. A method for one of volume-controlled filling and amount-controlled filling of containers with a filling material comprising at least two different components, said method comprising feeding a first component to a container to be filled, directly measuring one of an amount of said first component and a volume of said first component, carrying out one of an amount-controlled introduction and a volume controlled introduction of at least one second component into said container indirectly by measuring one of an amount flow rate and a volumetric flow rate of said first component resulting from one of an amount flow rate and a volumetric flow rate of said at least one second component, wherein at least one of said one of an amount flow rate and a volumetric flow rate of said at least one second component is directly one of an amount flow rate and a volumetric flow rate flowing to a respective container, and one of an amount-measuring device and a volume-measuring device used for said measurement is flowed through in one and the same direction of flow during one of said direct measurement of the amount and the volume of the first component and the indirect measurement of one of the amount and the volume of the at least one second component, said method further comprising, before beginning a filling process, completely filling said second chamber and said second liquid channel with said second component, said second component being pressurized with a second pressure for filling said container, opening said second liquid channel for introducing said second component into said container at a third filling pressure that is lower than the second pressure, using one of the amount-measuring device and volume-measuring device, measuring a volumetric flow rate of said first component that results from a volumetric flow rate of said second component, upon reaching a nominal volume of said second component introduced into said container, closing said second liquid channel, opening said first liquid channel, and using one of the amount-measuring device and the volume-measuring device, introducing said first component into said container with the required nominal volume in a controlled manner.

16. The method of claim 15, wherein said first pressure is greater than said third pressure, and wherein said first pressure is less than said second pressure.

* * * * *